United States Patent [19]

Chesnut et al.

[11] Patent Number: 4,787,216

[45] Date of Patent: Nov. 29, 1988

[54] ADJUSTABLE ICE MAKER CONTROL

[75] Inventors: Paul B. Chesnut, Armstrong Township, Vanderburgh County; Robert H. Kraemer, Evansville, both of Ind.

[73] Assignee: Whirlpool Corporation, Benton Harbor, Mich.

[21] Appl. No.: 108,755

[22] Filed: Oct. 15, 1987

[51] Int. Cl.[4] ..... F25C 1/04

[52] U.S. Cl. ..... 62/347; 62/233; 439/27

[58] Field of Search ..... 62/347, 233; 439/13, 439/27–30; 200/292, 67 DA, 67 E

[56] References Cited

U.S. PATENT DOCUMENTS

| | | | |
|---|---|---|---|
| 2,784,563 | 3/1957 | Baker | 62/347 X |
| 2,806,357 | 9/1957 | Pichler | 62/347 X |
| 3,299,656 | 1/1967 | Linstromberg et al. | 62/233 |
| 3,306,065 | 2/1967 | Fox | 62/347 X |
| 3,396,552 | 8/1968 | Buchser | 62/233 |
| 3,779,032 | 12/1973 | Nichols | 62/233 |
| 4,530,543 | 7/1985 | Keane | 301/63 PW |
| 4,659,157 | 4/1987 | Nigg et al. | 339/18 R |

*Primary Examiner*—William E. Tapolcai
*Attorney, Agent, or Firm*—Wood, Dalton, Phillips, Mason & Rowe

[57] ABSTRACT

An automatic ice maker structure having a water valve and rotary switch for controlling operation of the water valve. A manually adjustable switch contact structure is associated with the rotary switch for varying the time of operation of the water valve and thereby adjusting the size of ice bodies produced in the ice maker. The switch contact structure includes a support supporting the contact for reciprocal rectilinear positioning. The support has a thread engagement portion and a screw is provided having a shank threadedly engaging the portion of the support. A control knob is rotatively mounted on a wall of the housing of the control. The control knob is connected to a noncircular end portion of the screw for rotatively fixed, axially movable association therewith. The control knob is snap-fitted to the housing wall to engage the screw end. The control knob is rotatable over approximately 350° to effect a corresponding range of rectilinear reciprocation of the contact.

15 Claims, 1 Drawing Sheet

ADJUSTABLE ICE MAKER CONTROL

TECHNICAL FIELD

This invention relates to ice makers and in particular to means for effecting manual adjustment of the water level delivered to an ice maker mold for correspondingly adjusting the size of ice bodies formed therein.

BACKGROUND ART

In one form of conventional ice body maker, water is delivered into an upwardly opening mold, filling the cavities of the mold to a level determined by the quantity of water delivered through a supply valve.

It is desirable to permit the user of the ice maker to adjust the size of the ice bodies by correspondingly adjusting the amount of water delivered during each cycle of ice body production.

A number of different devices have been utilized for effecting adjustment of the quantity of water delivery. One excellent example of such a control is that illustrated in U.S. Pat. No. 3,779,032 of Duane C. Nichols, which patent is owned by the assignee hereof. As shown therein, manually operating means are provided for selectively positioning one of the control blades of the switching mechanism relative to a cam having a sequential arrangement of a first high portion, a low portion, and a second high portion. The control includes a knob accessible from the front of the housing of the device, permitting the user to adjust the water delivery by rotation of the knob.

In another form of well-known switch structure adapted for providing variable timed energization of an electrically operable device, such as a water delivery valve, the adjustment of the time is effected by a linear adjustment of a support arm carrying, at a distal end, an electrical contact adapted to cross a chordal slot in the face of a rotatable flat contact. Such a control means is illustrated in U.S. Pat. No. 4,659,157 of Daniel Nigg et al. In the Nigg et al. device, the support arm is adjusted longitudinally by a screw adjustment assembly to move the electrical contact so that, on subsequent rotation of the rotary switch plate, the electrical contact engages different points along the tapered leading edge of the rotary contact at the belt so as to vary the length of the path therealong traveled by the contact carried by the support arm, thereby controlling the timing duration of the electrical engagement between the contacts.

DISCLOSURE OF INVENTION

The present invention comprehends an improved manually operable control for adjusting the size of ice bodies produced in such an ice maker including an improved control knob structure for effecting adjustment of the contact support of such switch means.

The control structure of the present invention permits the ice maker to be provided by the manufacturer with or without the manual adjustment means, as desired.

More specifically, the invention comprehends the provision of a control knob which is rotatably mounted to a portion of the housing of the device, and which includes connecting means readily removably connected to the adjustment means.

In the illustrated embodiment, the control includes a manually adjustable switch contact structure having an electrical contact, support means supporting the contact for reciprocal rectilinear positioning, the support means having a thread engagement portion, a screw having a threaded shank threadedly engaging the threaded portion of the support means, and an end portion having a noncircular cross section, means for mounting the screw for axially fixed rotation about the axis of the shank, a housing for the structure having a wall provided with an opening aligned with the screw end portion, and a control knob having a manually operable portion, a connecting portion projecting from the manually operable portion and having a socket complementary to the screw end portion, and snap-fitting means rotatably mounting the hub to the wall in the opening with the screw end axially movably and rotatively fixedly received in the socket for rotation of the screw as an incident of rotation of the manipulating portion, whereby rotation of the control knob effects linear movement of the contact.

Means may be provided on the control knob and housing wall for limiting the amount of rotation of the control knob, and in the illustrated embodiment, the motion-limiting means limits the rotation to less than 360°.

The housing defines annular bearing means for rotatively journaling the knob.

The knob includes a split tubular retainer extending through the wall opening and having radially outwardly projecting distal end portions defining the snap-fitting means.

In the illustrated embodiment, the end portion of the screw defines a polygonal cross section and the knob defines a connecting portion having a complementary polygonal socket for nonrotatively, axially movably engaging the screw end.

The adjustable switch contact structure is adapted for use in an automatic ice maker having a water valve and a rotary switch means for controlling operation of the water valve. The contact structure is associated with the switch means for varying the time of operation of the water valve.

The rotary switch defines an axis of rotation and a radial extending gap. The switch contact defines means for bridging the gap adjustably substantially radially of the axis of rotation of the switch as an incident of the rectilinear positioning of the support.

In the illustrated embodiment, the control element, or knob, includes portions extending through the housing opening to engage the connecting means mounted fully within the housing.

The housing includes a boss on which the control knob is rotatably slidable for maintained accurate axial alignment with the connecting means within the housing.

The adjustable switch contact control structure of the present invention is extremely simple and economical of construction, while yet providing a highly improved, low cost means for adjusting the size of ice bodies formed in an automatic ice maker.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
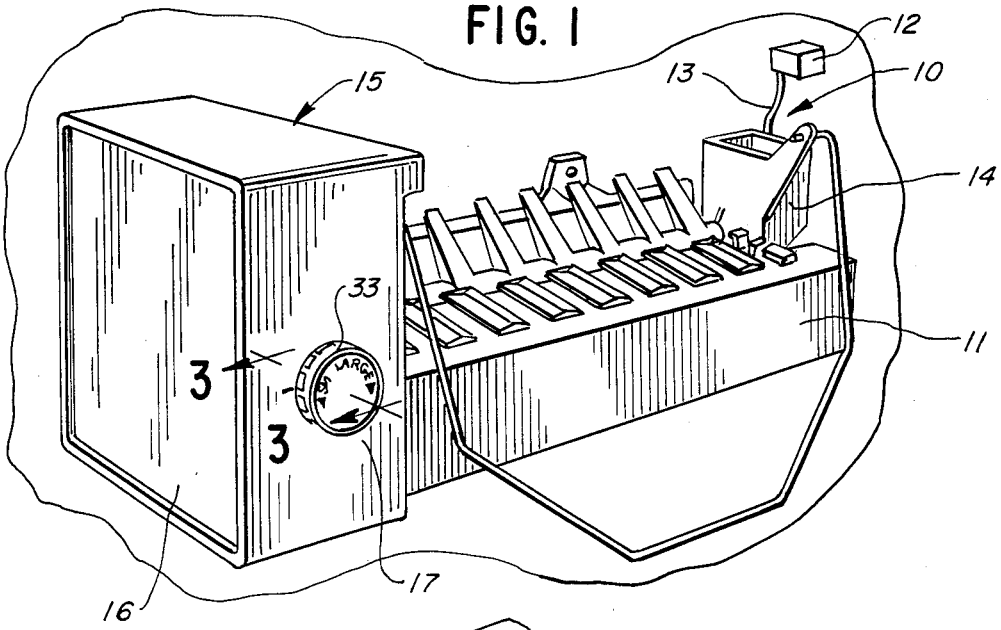
FIG. 1 is a fragmentary perspective view of an ice body maker provided with an adjustable control embodying the invention.

In the illustrative embodiment of the invention as disclosed in the drawing, an ice maker generally designated 10 includes an ice mold 11 in which a plurality of ice bodies are formed from water delivered thereinto through a supply valve 12, a connecting supply conduit 13, and a delivery chute 14.

The ice maker includes a control generally designated 15 mounted within a housing 16 having a wall portion 17 provided with an opening 18.

Figure 3:
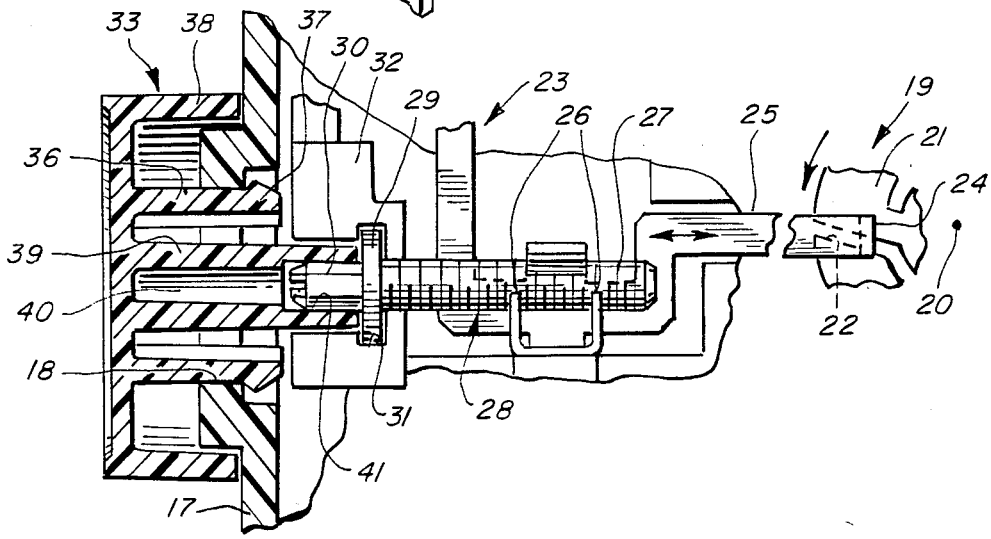
FIG. 3 is a fragmentary enlarged vertical section taken substantially along the line 3—3 of FIG. 1.

Control 15 includes means for automatically controlling the entire operation of the ice maker and, more specifically includes control means generally designated 19 for controlling the solenoid water valve 12. Control 19 comprises a rotary switch rotatable about an axis 20 and having a conductive portion 21 defining a generally radially extending gap 22. As shown in FIG. 3, the gap extends at a small angle to the radius.

The adjustable switch contact structure generally designated 23 includes an electrical contact 24 which bridges the gap 22.

Contact 22 is carried on a support 25 for reciprocal rectilinear positioning relative to the gap and generally radially of axis 20.

The support further defines a pair of thread engagement edges 26 adapted to have threaded engagement with a threaded shank 27 of a screw member 28. The screw member includes an annular collar 29 and an outer end 30 having a polygonal cross section, and in the illustrated embodiment, having a hexagonal cross section.

As seen in FIG. 3, collar 29 is rotatably received in an annular groove 31 of a mounting element 32 providing axially fixed rotatable mounting of the screw 28 in coaxial alignment with opening 18 of housing wall 17.

Rotation of screw 28 is effected selectively by a manually operable control knob 33 disposed outwardly of the housing 16, as shown in FIG. 1. Housing wall 17 is provided with an outwardly projecting annular boss 34 defining opening 18 and serving as means for journaling the control knob.

More specifically, the control knob is provided with an annular array generally designated 35 of spring fingers comprising segmentally cylindrical tongues 36 each having a radially outwardly enlarged inner distal end 37 snap-fitting inwardly of the boss 34 when the array is inserted through the opening 18, as shown in FIG. 3. The knob includes a tubular sidewall 38 having a length preselected to cooperate with the tongue ends 37 to retain the knob against axial displacement on the wall 17, while allowing ready rotation thereof coaxially of boss 34 and, thus, coaxially of screw 28.

The knob is removably connected to the screw end 30 by a connecting portion 39 comprising a tubular inwardly extending portion of the knob, having an axial inwardly opening socket 40. The inner end 41 of the socket has a hexagonal configuration complementary to the hexagonal configuration of screw end 30 and slidingly receives the screw end for rotatively fixed, axially movable association therebetween.

Figure 2:
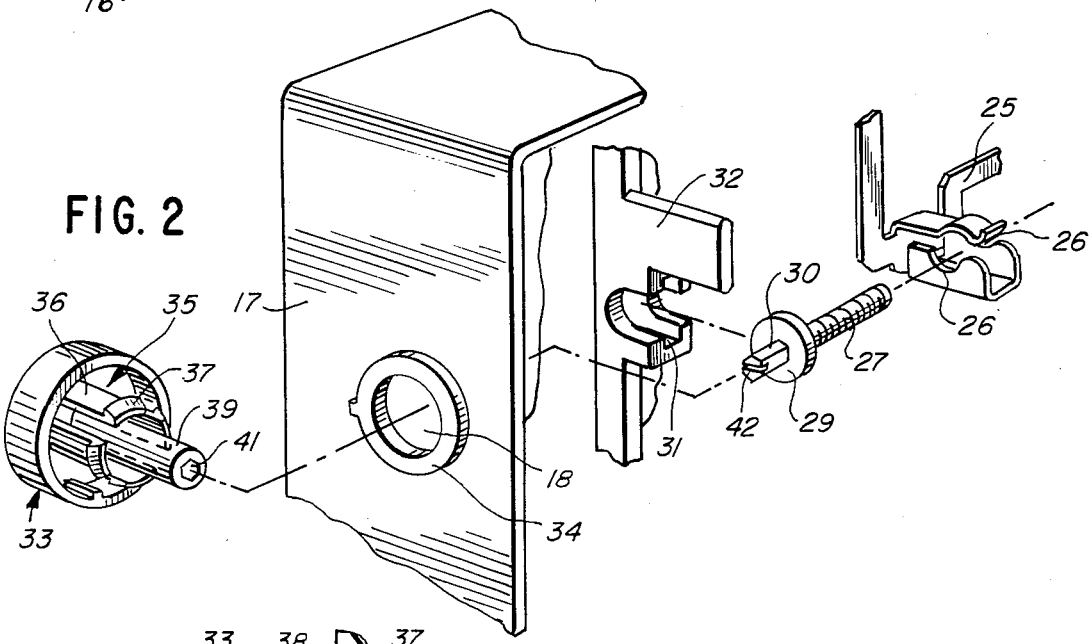
FIG. 2 is a fragmentary exploded perspective view illustrating portions of the elements of the control structure.

As seen in FIGS. 2 and 3, the screw end 30 may be provided with an outwardly opening diametrical slot 42 for effecting rotation of the screw by means of a screwdriver, or the like, inserted through opening 18 in the absence of knob 33.

Thus, broadly, the invention comprehends the provision of an adjustable switch contact structure 23 which includes an electrical contact 24, a housing 16 having a wall portion 17 defining an opening 18, a support 25 for supporting contact 24 for reciprocal rectilinear positioning, a control element or knob 33, means 35 for mounting the control element rotatively to the housing to extend coaxially through opening 18 into engagement with the end 30 of screw 28 for effecting adjustment of the disposition of contact 24 as a function of the rotary movement of the control element on the housing. The connecting means between the control knob and screw comprises a male/female connector providing axially movable, rotatively fixed connection between the control knob and screw when the control knob is installed on the housing wall 17, with the connecting portion 39 extending coaxially through the opening.

Thus, the control knob is positioned by its mounting to the housing wall, and the screw is positioned in mounting element 32 for facilitated interconnection solely by the mounting of the control knob to the housing into snap-fitted rotatable relationship therewith.

The rotary motion of the control knob is effectively converted into reciprocal rectilinear motion of the contact 24 for facilitated adjustment of the water-fill time and, thus, adjustment of the ice body size by the user.

The foregoing disclosure of specific embodiments is illustrative of the broad inventive concepts comprehended by the invention.

We claim:

1. In an automatic ice maker having a water valve and rotary switch means for controlling operation of the water valve, a manually adjustable contact structure associated with said rotary switch means for varying the time of operation of said water valve, said contact structure comprising:

an electrical contact;

support means supporting said contact for reciprocal rectilinear positioning relative to said switch means, said support means having a thread engagement portion;

a screw having a threaded shank threadedly engaging said thread engagement portion of the support means, and an end portion having a noncircular cross section;

means for mounting said screw for axially fixed rotation about the axis of said shank;

a housing for said structure having a wall provided with an opening aligned with said screw end portion; and a control knob having a manually operable portion, a connecting portion projecting from said manually operable portion and having a socket complementary to said screw end portion, and knob mounting means rotatably mounting said knob to said housing wall in said opening with said screw end axially movably and rotatively fixedly received in said socket for rotation of said screw as an incident of rotation of said manually operable portion, whereby rotation of said control knob effects linear movement of said contact in engagement with said rotary switch means, said contact and rotary switch means comprising cooperating means for varying the time of operation of the water valve as a function of the position of said contact relative to said rotary switch means.

2. The automatic ice maker apparatus of claim 1 further including means on said control knob and housing wall for limiting the amount of rotation of said control knob.

3. The automatic ice make apparatus of claim 1 further including means on said control knob and housing wall for limiting the amount of rotation of said control knob to less than 360°.

4. The automatic ice maker apparatus of claim 1 wherein said knob-mounting means includes annular bearing means on said housing wall for rotatably journaling said knob.

5. The automatic ice maker apparatus of claim 1 wherein said knob-mounting means includes a split tubular retainer extending through said wall opening and having a radially outwardly projecting distal end portion defining snap-fitting means.

6. The automatic ice maker apparatus of claim 1 wherein said control knob-mounting means includes a split tubular retainer disposed coaxially outwardly about said connecting portion thereof and extending through said wall opening and having a radially outwardly projecting distal end portion defining snap-fitting means.

7. The manually adjustable switch contact structure of claim 1 wherein said end portion of the screw defines a polygonal cross section.

8. The ice maker apparatus of claim 1 wherein said rotary switch defines an axis of rotation, and a radially extending gap, and said contact defines means for bridging said gap, said contact being adjustable substantially radially of said axis as an incident of said rectilinear positioning.

9. The ice maker apparatus of claim 1 wherein said control knob and housing are provided with cooperating stop means for limiting the adjustment of said contact by rotation of said manually operable portion.

10. The automatic ice maker apparatus of claim 1 wherein said support means is disposed in said housing.

11. The automatic ice maker apparatus of claim 1 wherein said knob-mounting means includes spring fingers on said control element extending through said opening.

12. The automatic ice maker apparatus of claim 1 wherein said knob-mounting means includes segmentally cylindrical spring fingers on said control element extending through said opening.

13. The automatic ice maker apparatus of claim 1 wherein said screw is disposed within said housing.

14. The automatic ice maker apparatus of claim 1 wherein said control knob-mounting means is slidably engaged with said housing wall.

15. The automatic ice maker apparatus of claim 1 wherein said control knob-mounting means is slidably engaged with said housing wall about said opening.

* * * * *